US005673792A

United States Patent [19]

Aikio

[11] Patent Number: 5,673,792

[45] Date of Patent: Oct. 7, 1997

[54] BASE PLATE FOR A BOTTLE PACKAGE

[75] Inventor: Veijo Aikio, Vantaa, Finland

[73] Assignee: Oy Hartwall Ab, Helsinki, Finland

[21] Appl. No.: 397,249

[22] PCT Filed: Sep. 29, 1993

[86] PCT No.: PCT/NO93/00141

§ 371 Date: Apr. 28, 1995

§ 102(e) Date: Apr. 28, 1995

[87] PCT Pub. No.: WO94/07758

PCT Pub. Date: Apr. 14, 1994

[30] Foreign Application Priority Data

Sep. 29, 1992 [FI] Finland ..... 924377

[51] Int. Cl.[6] ..... B65D 21/02

[52] U.S. Cl. ..... 206/509; 206/203; 206/427; 220/514; 220/519

[58] Field of Search ..... 206/427, 504, 206/503, 511, 509, 516, 203, 821; 220/509, 512, 514, 516, 517–519

[56] References Cited

U.S. PATENT DOCUMENTS

| | | | |
|---|---|---|---|
| 4,095,720 | 6/1978 | Delbrouck et al. | 220/219 |
| 4,700,837 | 10/1987 | Hammett | 206/427 |
| 4,848,573 | 7/1989 | Salacuse | 206/427 |
| 5,263,605 | 11/1993 | Caton | 206/427 |

FOREIGN PATENT DOCUMENTS

| | | |
|---|---|---|
| 0324699 | 7/1989 | European Pat. Off. . |
| 0362091 | 4/1990 | European Pat. Off. . |
| 0521705 | 1/1993 | European Pat. Off. . |
| 1347005 | 2/1974 | United Kingdom . |
| 8200989 | 4/1982 | WIPO . |
| 8201536 | 5/1982 | WIPO . |

*Primary Examiner*—Paul T. Sewell
*Assistant Examiner*—Luan K. Bui
*Attorney, Agent, or Firm*—Dennison, Meserole, Pollack & Scheiner

[57] ABSTRACT

A bottle package for placing bottles in a plurality of superposed layers in which the bottles are upright comprising base plates which are placed between the bottle layers to provide an efficient transport and sales package for the bottles. The base plates incorporate on one surface seats the inner surfaces of which bear, for at least a portion thereof, on the mouth or neck portion of a bottle to be used in association with the base plate as the base plate is disposed on a layer of bottles, and on the other surface, cup-like seats remaining between the neck portion seats, the dimensions and shape of the cup-like seats substantially conforming to the shape of the bottom of the bottles to be used in association with the base plate for forming a package.

3 Claims, 2 Drawing Sheets

BASE PLATE FOR A BOTTLE PACKAGE

SUMMARY OF THE INVENTION

This invention relates to a bottle package, for placing bottles in a plurality of superposed layers in which the bottles stand upright, comprising base plates to be laid between the bottle layers, the base plates incorporating on one surface first seats the inner surfaces of which bear, for at least a portion thereof, on the mouth or neck portion of the bottles. The other surface incorporating cup-like second seats remaining between the first seats and being inverse to the first seats, the dimensions and shape of the cup-like seats substantially conforming to the shape of the bottom of the bottles to be used in association with the base plate.

BACKGROUND OF THE INVENTION

A package substantially as described above is known from European published application 0 324 699. In that application, however, in distinction to the above, the seats reserved for the bottle mouth are openings, and thus the upper base plate bears on the neck portions of the lower bottle layer in the package. An obvious result from this is wedging of the base plate to the tapered bottle necks, which substantially impedes the use of the package. Further, the supports provided for the bottle bottoms are rather small, and thus the bottles cannot stand very rigidly on the base plate after the upper base plate covering said bottle layer is removed. The package is a relatively stable entity, but this stability is based specifically on the wedging of the base plates relative to the bottle necks and thereby presents a considerable problem when the package is taken apart.

OBJECT OF THE INVENTION

It is an object of the present invention to provide a package which does not involve the problems of the prior art package but has the advantage, that is, the package is stable and space-saving and the bottles are substantially visible, which is thought to be of significance in attempting to influence consumer choices.

The above objects are achieved with a package according to the invention, which is characterized in that cup-like seats comprise a generally tapered protuberance projecting centrally from the bottom of the seat, the dimensions and shape of the protuberance conforming to the dimension and shape of the socket provided in the bottom of the bottle to be used in association with the base plate.

Since the package of the invention is primarily, although not solely, intended for plastic recyclable bottles, i.e. what may be called RefPET bottles, in which the bottom of the bottle has a generally circular shape consequent on the bottle material, but which necessarily also have a socket centrally of the bottom, a very balanced upright position is achieved for the bottle by means of a base construction as described above. If the bottom of the seat did not have a generally tapered protuberance, the bottle could rotate in its cup-like seat.

Preferably the protuberance in the bottom of the cup-like seats is generally frusto-conical in shape. Furthermore, it is preferable in view of the manageability of the base plate in other respects and also in view of lightness and cleaning that an opening is provided in the middle of said generally frusto-conical protuberance.

The invention also relates to a base plate for use in a bottle package wherein the bottles are placed in a plurality of superposed layers in which the bottles are upright and between which the base plates are located; the generally rectangular base plates incorporating on their one surface seats the inner surfaces of which bear, for at least part thereof, on the mouth or neck portion of the bottles to be used in association with the base plate when the base plate is disposed on the bottle layer, and on their other surface cup-like seats remaining between the seats and being inverse to said seats, the dimensions and shape of said cup-like seats substantially conforming to the shape of the bottom of the bottles to be used in association with the base plate, and in which base plate the first-mentioned seats and the cup-like seats that are staggered relative to the first-mentioned seats are so located that two adjacent corners of the base plate have said first-mentioned seat and the other two adjacent corners have a cup-like seat. Such a base plate is in turn characterized in that the bottoms of the cup-like seats incorporate central openings having a diameter such as to accept entry of the protuberance provided by the first-mentioned seat on the reverse side of the plate at least partly through said opening, thus enabling the base plates which are alternately turned 180° relative to one another to be stacked one on top of the other in such a way that the protuberances in the lower plate are partly pushed through the openings in the upper plate.

In the package of the invention, the bottle layers bear on one another so rigidly that especially if the number of bottle layers is maintained within reasonable bounds, the package does not even need an outer covering. The package can, however, be easily encased with an outer covering of fluted board or plastic shrink film, for instance, and such an outer covering will reliably secure the integrity of the package even in rough handling, and prevent the bottles from becoming dusty during transport and storage.

In order that a maximum number of bottles may be accommodated between the base plates, it is preferred that the wall of the first-mentioned seat concurs with the wall of said cup-like seats at least at points where it bears on the mouth or neck portion of the bottle.

The base plate of the invention can be developed further, if so desired, in a variety of ways with an aim to secure the bottles as effectively as possible between the base plates. In particular, such securing arrangements come into question for the mouth or neck portion of the bottle, since it is not self-evident that dimensionally accurate seats are inherently produced for them in the base plate, as is the case with the cup-like seats for the bottoms of the bottles. As one such securing arrangement, an alternative construction can be mentioned in which the first-mentioned seats have a flat bottom the dimensions and shape of which conform to the upper surface of the cap of the bottles to be used in association with the base plate. Such an arrangement, in which possibly rather shallow seats are provided for the bottle caps, is quite useful in the sense that for instance the diameters of caps used in association with one-liter bottles are dimensionally very similar. This arrangement does not, however, necessarily guarantee the securing of empty recycled bottles between the base plates.

DETAILED DESCRIPTION OF THE INVENTION

Figure 1:
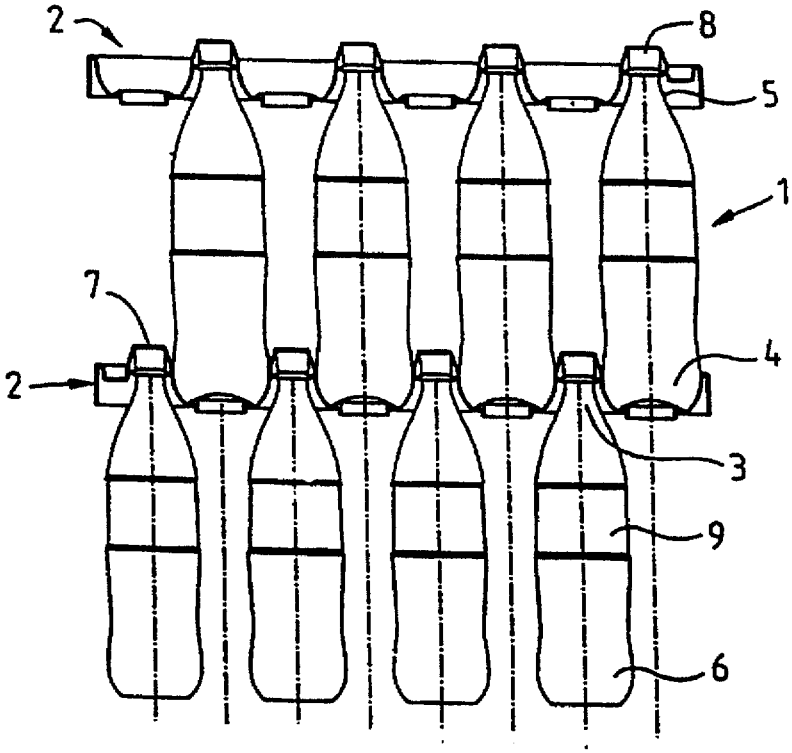
FIG. 1 shows a cross-section of part of a package according to the invention.
Figure 3:
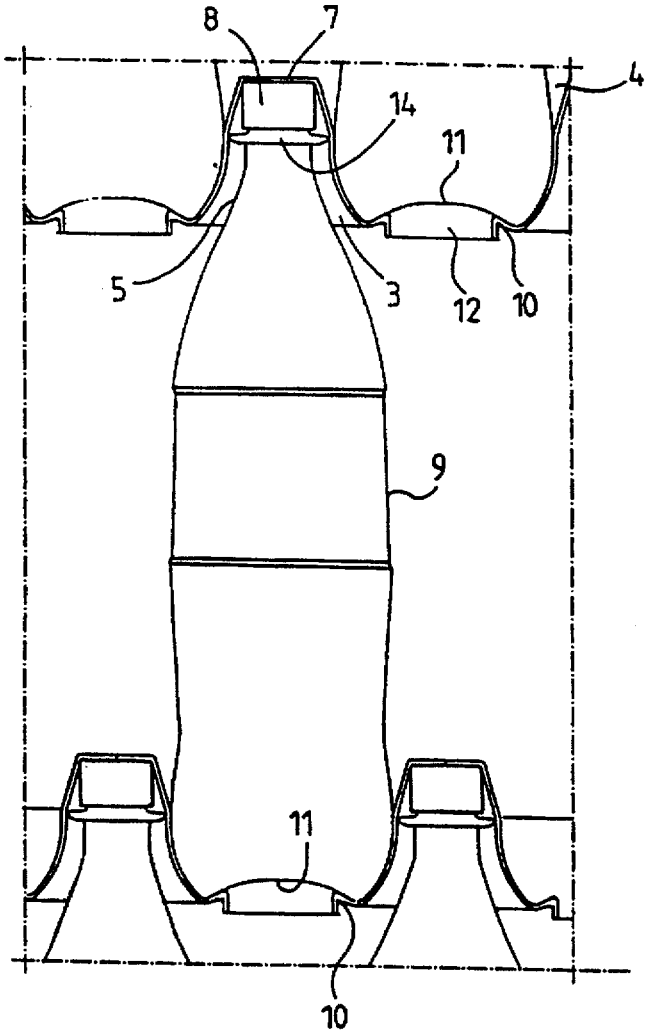
FIG. 3 shows in more detail the securing of a bottle between two base plates in the package of the invention.

FIG. 1, and FIG. 3 in more detail, show the accommodation of bottle layers comprising a plurality of bottles 1 stand upright between base plates 2. The bottle comprise a bottom portion 6, a middle portion 9 and a neck portion 5 terminating in a cap 8. Conventionally, the bottom portion 6 formed is cup-like and tapers somewhat towards the bottom. Particularly in plastic recyclable bottles, i.e. what may be called RefPET bottles, the bottom is circular but comprises an inverse generally tapered or dome-shaped central indentation. In plastic bottles, this inverse indentation is indispensable for preventing the pressure in the bottle from bulging the bottle bottom out into a rounded shape. In plastic bottles neck portion 5 is generally tapered and further comprises, a projecting annular shoulder 14 substantially at the point where the threaded portion of the bottle neck starts.

In the base plate 2, cup-like seats 4 are provided for the cup-like bottom portion 6 of the bottles. The dimensions and shape of the cup-like seats substantially conform to the shape of the cup-like bottom portions 6 of the bottles. As is more clearly seen from FIG. 3, the bottom of the cup-like seat 4 incorporates a frusto-conical protuberance 10 which is of great significance for the balanced upright standing of the bottles. Since the diameter and shape of the protuberance 10 conform to the dimensions and shape of the central indentation or socket 11 provided in the bottom of the bottle, it is not possible for the bottle to tilt unless it simultaneously emerges above the protuberance 10. Since a bottle is relatively heavy when filled, the protuberance 10 very effectively prevents tilting of the bottle. The significance of the protuberance 10 is still greater when the bottles are empty and are being returned to the beverage manufacturer in packages. On account of the lightness of the bottles and the rounded shape of their bottoms, returning the bottles in upright position in their package would be impossible without the support provided by the protuberance 10. Furthermore, the central portion of the frusto-conical protuberance 10 has a circular opening 12 that makes the base plate lighter and facilitates its cleaning. This opening 12 also has another function, which will be reverted to hereinafter. Further, the lowermost point of the cup-like seats 4 may have one or more small openings so that washing water may not remain in the annular well around the protuberance 10 when the base plate is being washed.

Figure 2:
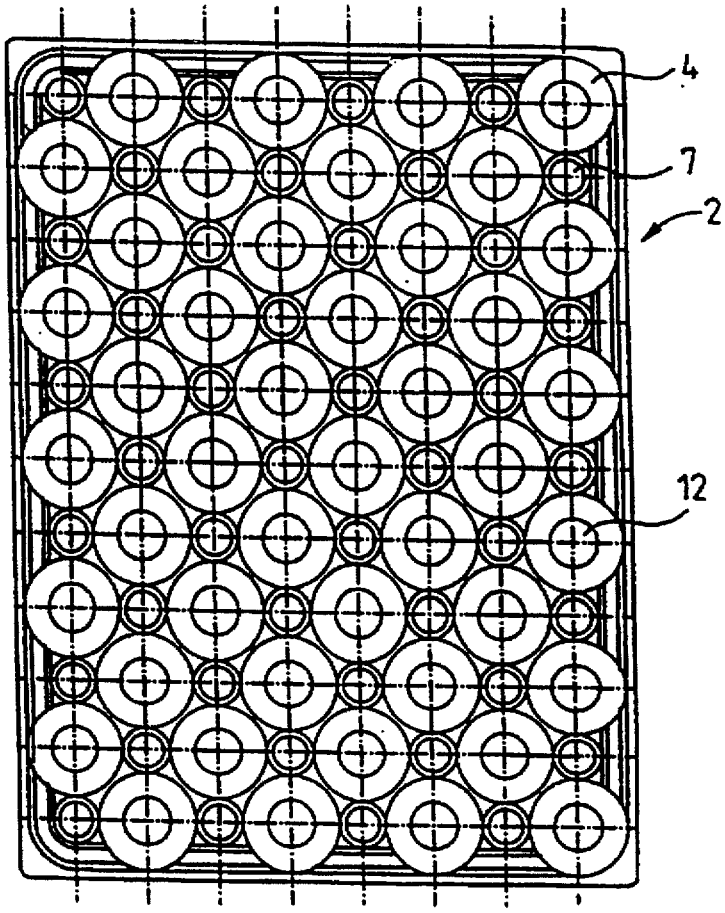
FIG. 2 is a top view of a base plate included in the package of FIG. 1.
Figure 4:
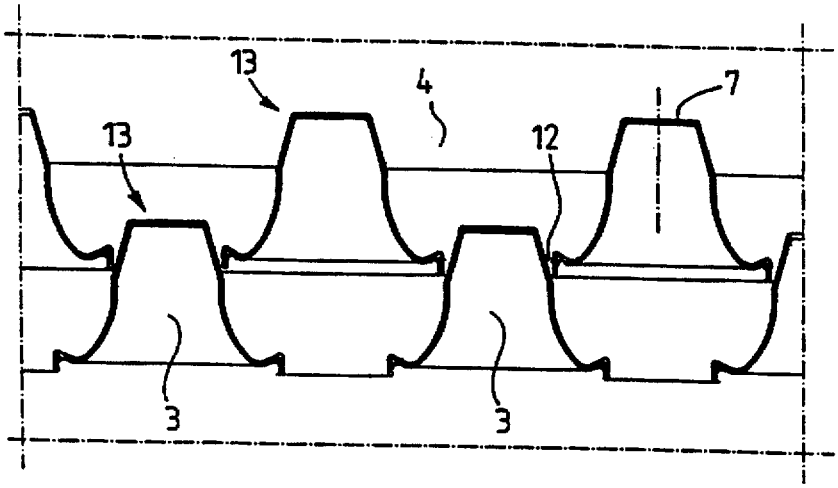
FIG. 4 shows part of two superimposed base plates.

FIG. 2 shows the manner in which the cup-like seats 4 and the inverse seats 3 for the bottle necks 5 remaining between them are disposed in the generally rectangular base plate 2. Such a staggered compact disposition enables accommodation of a maximum number of bottles in the package. In such a case, the walls of the cup-like seats 4 concur at least partly with the walls of the inverse seats 3, as is also to be seen from FIGS. 1 and 3. Furthermore, the seats 3 and the cup-like seats 4 are so arrayed that two adjacent corners of the place have seats 3 and the other two adjacent corners have seats 4. Thus only one kind of plate is needed for a package as shown in FIG. 1, and plates in superimposed layers are turned 180° relative to one another. FIG. 1 also shows that by removing the bottles from the package, the plates 2 can be stacked as shown in FIG. 4. The protuberances 13 provided by the inverse seats 3 on the other surface of the plate can partly project through the openings 12 located centrally in the bottoms of the cup-like seats. Thus the base plates can to be stacked in a rigid and space-saving manner one on top of the other, yet so that they are not wedged within one another.

As will be seen from FIGS. 1 and 3, the seats 3 are so dimensioned that the collar 14 in the neck portion of the bottle centers the bottle accurately relative to the inverse seat 3. The inverse seats 3 further have a flat top 7, the dimensions and shape thereof conforming to the upper surface of the cap 8 of the a bottle. Thus the bottle cap 8 will be reliably housed in its correct place. When a bottle is empty and without a cap, centering is performed by the collar 14.

In the above, the invention has been described by means of one exemplary embodiment. It is to be understood that there are also a number of other ways obvious to a person skilled in the art for modifying the base plate described, yet without departing from the scope defined by the appended claims.

I claim:

1. A stackable base plate for use in a bottle package where bottles are placed upright in a plurality of superposed layers between which layers the base plate is located;

said base plate being of a substantially rectangular shape having on a first surface bottle neck shaped seats with inner surfaces for centering a bottle neck portion and on a second surface having cup-like seats;

the dimensions and shape of these cup-like seats substantially conforming to the shape of a socket in the bottle bottom portion, the cup-like seats including a centrally projecting tapered protuberance having a continuous frusto-conical shape for preventing tilting of a bottle, said tapered protuberance forming a cylindrically shaped opening having a diameter sufficient to enable a neck-shaped seat to pass therethrough; and the neck-shaped seats being arranged between the cup-like seats.

2. A base plate according to claim 1, wherein a wall of the neck-shaped seat is formed to concur with a wall of the cup-like seat.

3. A stackable base plate for use in a bottle package where bottles are placed upright in a plurality of superposed layers between which layers the base plate is located;

said base plate being of a substantially rectangular shape having on a first surface bottle neck shaped seats with inner surfaces for centering a bottle neck portion and on a second surface having cup-like seats;

the dimensions and shape of these cup-like seats substantially conforming to the shape of a socket in the bottle bottom portion, and the cup-like seats further including a continuous centrally projecting frusto-conical tapered protuberance for preventing tilting of a bottle, said tapered protuberance forming an opening having a diameter sufficient to enable a neck-shaped seat to pass therethrough; and the neck-shaped seats and cup-like seats being staggered and located so that two adjacent corners of a base plate have said neck-shaped seats, two other adjacent corners having said cup-like seats, so that base plates which are alternately turned 180° relative to one another can be stacked one on top of the other in a way where the protuberances in a first base plate are partly pushed through the openings in a second base plate.

* * * * *